US012180677B2

(12) United States Patent
Ghosh et al.

(10) Patent No.: US 12,180,677 B2
(45) Date of Patent: Dec. 31, 2024

(54) LANDSCAPE CHANNELING USING AN AUTONOMOUS ROBOTIC SOIL DREDGER

(71) Applicant: INTERNATIONAL BUSINESS MACHINES CORPORATION, Armonk, NY (US)

(72) Inventors: Partho Ghosh, Kolkata (IN); Sarbajit K. Rakshit, Kolkata (IN); Akash U. Dhoot, Pune (IN)

(73) Assignee: International Business Machines Corporation, Armonk, NY (US)

( * ) Notice: Subject to any disclaimer, the term of this patent is extended or adjusted under 35 U.S.C. 154(b) by 134 days.

(21) Appl. No.: 17/806,740

(22) Filed: Jun. 14, 2022

(65) Prior Publication Data

US 2023/0399813 A1 Dec. 14, 2023

(51) Int. Cl.
*E02F 5/14* (2006.01)
*E02F 9/20* (2006.01)

(52) U.S. Cl.
CPC ..... *E02F 5/145* (2013.01); *E02F 9/205* (2013.01)

(58) Field of Classification Search
CPC ..... E02F 5/145; E02F 9/205
See application file for complete search history.

(56) References Cited

U.S. PATENT DOCUMENTS 10,039,242 B1 8/2018 Goldwasser
2010/0307397 A1 12/2010 Byles
2022/0000025 A1* 1/2022 Middelberg ..... A01D 41/1274
2022/0013199 A1 1/2022 Kozloski
2022/0124961 A1 4/2022 Eda
2022/0171906 A1 6/2022 Suto

FOREIGN PATENT DOCUMENTS

CN 110705868 A 1/2020
CN 111251304 A 6/2020

OTHER PUBLICATIONS

International Search Report and Written Opinion for International Application No. PCT/CN2023/089034, International filing date: Apr. 18, 2023, Date of Mailing: Jul. 10, 2023, 7 pages.

(Continued)

*Primary Examiner* — Grant Moubry
*Assistant Examiner* — Ruben Picon-Feliciano
(74) *Attorney, Agent, or Firm* — Jordan T. Schiller

(57) ABSTRACT

A computer-implemented method for dynamic landscape channeling using an autonomous robotic soil dredger. The method derives one or more landscape metrics, wherein the one or more landscape metrics comprise soil metrics, environmental conditions, and vegetation water consumption metrics. The method further generates a digital twin of proposed trench and ridge metrics based on the derived one or more landscape metrics, wherein the proposed trench and ridge metrics comprise a depth of the trench, a distance between one or more trenches, a stream size, a slope of the trench, and a shape of the trench. The method further determines a trench pattern based on the generated digital twin of the proposed trench and ridge metrics and collaborates with the autonomous robotic soil dredger to generate the trench pattern.

20 Claims, 5 Drawing Sheets

(56) References Cited

OTHER PUBLICATIONS

Brouwer, et al., "Chapter 3. Furrow Irrigation," Irrigation Water Management: Irrigation Methods Training manual No. 5, 14 pages, Retrieved from the Internet: <URL: http://www.fao.org/3/S8684E/s8684e04.htm>.

Disclosed Anonymously, "Automatic irrigation," agriculture.vic.gov.au [online], [accessed on Nov. 22, 2021], 4 pages, Retrieved from the Internet: <URL: https://agriculture.vic.gov.au/farm-management/water/irrigation/automatic-irrigation>.

Disclosed Anonymously, "Soil Properties," SoilSensor.com [online], [accessed on Apr. 27, 2022], Retrieved from the Internet: <URL: https://soilsensor.com/soil/soil-properties/>.

Disclosed Anonymously, "Soil Sensors: Everything You Need to Know About Soil Monitoring Instruments," SoilSensor.com [overview], [accessed on Apr. 27, 2022], 4 pages, Retrieved from the Internet: <URL: https://soilsensor.com/>.

Disclosed Anonymously, "Soil Types," boughton.co.uk [online], [accessed on Apr. 27, 2022], 3 pages, Retrieved from the Internet: <URL: https://www.boughton.co.uk/products/topsoils/soil-types/>.

Disclosed Anonymously, "Tata consultancy services—empowering farmers with mobile technology," ofaminia.org [blog], [accessed on Apr. 25, 2022], 5 pages, Retrieved from the Internet: <URL: https://www.oxfamindia.org/blog/data-consultancy-services-empowering-farmers-mobile-technology>.

Dislosed Anonymously, "What is Evapotranspiration?," HydroPoint [online], [accessed on Apr. 27, 2022], 6 pages, Retrieved from the Internet: <URL: https://www.hydropoint.com/what-is-evapotranspiration/>.

Jud, et al., "Autonomous Free-Form Trenching Using a Walking Excavator," IEEE Robotics and Automation Letters, Oct. 2019 [accessed on Apr. 25, 2022], pp. 3208-3215, vol. 4, No. 4, IEEE, DOI: 10.1109/LRA.2019.2925758, Retrieved from the Internet: <URL: https://ieeexplore.ieee.org/document/8750818>.

Mell, et al., "The NIST Definition of Cloud Computing", National Institute of Standards and Technology, Special Publication 800-145, Sep. 2011, 7 pages.

Sciencedirect, "Flood Irrigation," The Future Rice Strategy for India [overview], 2017 [accessed on Apr. 27, 2022], 10 pages, Retrieved from the Internet: <URL: https://www.sciencedirect.com/topics/agricultural-and-biological-sciences/flood-irrigation>.

Shademani, et al., "Conceptual design and analysis of a dredger robot for irrigation canals," Industrial Robot: the international journal of robotics research and application 2019, pp. 819-827, vol. 46, No. 6, DOI 10.1108/IR-03-2019-0065, Retrieved from the Internet: <URL: https://www.emerald.com/insight/content/doi/10.1108/IR-03-2019-0065/full/html>.

Shademani, et al., "Design and Analysis of a Dredger Robot for Covered Irrigation Canals," Proceedings of the 5th RSI International Conference on Robotics and Mechatronics (IcRoM 2017), Oct. 25-27, 2017, pp. 162-167, Retrieved from the Internet: <URL: https://www.semanticscholar.org/paper/Design-and-Analysis-of-a-Dredger-Robot-for-Covered-Shademani-Zarafshan/8523ef4c5133a753a30b05970fda80819b937209>.

Sieg, et al., "Green Revolution in the Desert," The Furrow [article], Jan. 2020 [accessed on Apr. 27, 2022], 13 pages, Retrieved from the Internet: https://thefurrow.co.uk/irrigation-cultivation-in-the-desert-sekem-egypt/.

TCS, "TCS mKRISHI," tcs.com [online], [accessed on Apr. 25, 2022], 2 pages, Retrieved from the Internet: <URL: https://www.tcs.com/enabling-digital-farming-with-pride>.

* cited by examiner

LANDSCAPE CHANNELING USING AN AUTONOMOUS ROBOTIC SOIL DREDGER

BACKGROUND

The present disclosure relates generally to the field of cognitive computing, Internet of Things (IoT), and more particularly to data processing and dynamic landscape channeling.

Trenches, or channeling, of a landscape (e.g., barren, sandy, mountainous, contour, etc.) is primarily used for water conservation, groundwater recharge, and recharging the humidity of multifarious soils like clay or sand. Trenches are small, parallel channels made to carry/retain/recharge water to irrigate a landscape and/or vegetation.

Field trenches boost precipitation gathering by breaking the ground's slope and thereby decreasing water flow velocity. Field trenches also improve water infiltration and reduce soil erosion by reducing water runoff. Existing research and use cases have found that with optimal trenching, barren landscapes may be turned into a blooming oasis.

However, channeling a trench comes with pre-existing problems depending on the landscape involved.

SUMMARY

Embodiments of the present invention disclose a method, a computer program product, and a system.

A method, according to an embodiment of the invention, in a data processing system including a processor and a memory. The method includes deriving one or more landscape metrics, wherein the one or more landscape metrics comprise soil metrics, environmental conditions, and vegetation water consumption metrics. The method further includes generating a digital copy of proposed trench and ridge metrics based on the derived one or more landscape metrics, wherein the proposed trench and ridge metrics comprise a depth of the trench, a distance between one or more trenches, a stream size, a slope of the trench, and a shape of the trench. The method further includes determining a trench pattern based on the generated digital copy of the proposed trench and ridge metrics and collaborating with the autonomous robotic soil dredger to generate the trench pattern.

A computer program product, according to an embodiment of the invention, includes a non-transitory tangible storage device having program code embodied therewith. The program code is executable by a processor of a computer to perform a method. The method includes deriving one or more landscape metrics, wherein the one or more landscape metrics comprise soil metrics, environmental conditions, and vegetation water consumption metrics. The method further includes generating a digital copy of proposed trench and ridge metrics based on the derived one or more landscape metrics, wherein the proposed trench and ridge metrics comprise a depth of the trench, a distance between one or more trenches, a stream size, a slope of the trench, and a shape of the trench. The method further includes determining a trench pattern based on the generated digital copy of the proposed trench and ridge metrics and collaborating with the autonomous robotic soil dredger to generate the trench pattern.

A computer system, according to an embodiment of the invention, includes one or more computer devices each having one or more processors and one or more tangible storage devices; and a program embodied on at least one of the one or more storage devices, the program having a plurality of program instructions for execution by the one or more processors. The program instructions implement a method. The method includes deriving one or more landscape metrics, wherein the one or more landscape metrics comprise soil metrics, environmental conditions, and vegetation water consumption metrics. The method further includes generating a digital copy of proposed trench and ridge metrics based on the derived one or more landscape metrics, wherein the proposed trench and ridge metrics comprise a depth of the trench, a distance between one or more trenches, a stream size, a slope of the trench, and a shape of the trench. The method further includes determining a trench pattern based on the generated digital copy of the proposed trench and ridge metrics and collaborating with the autonomous robotic soil dredger to generate the trench pattern.

DETAILED DESCRIPTION

Figure 1:
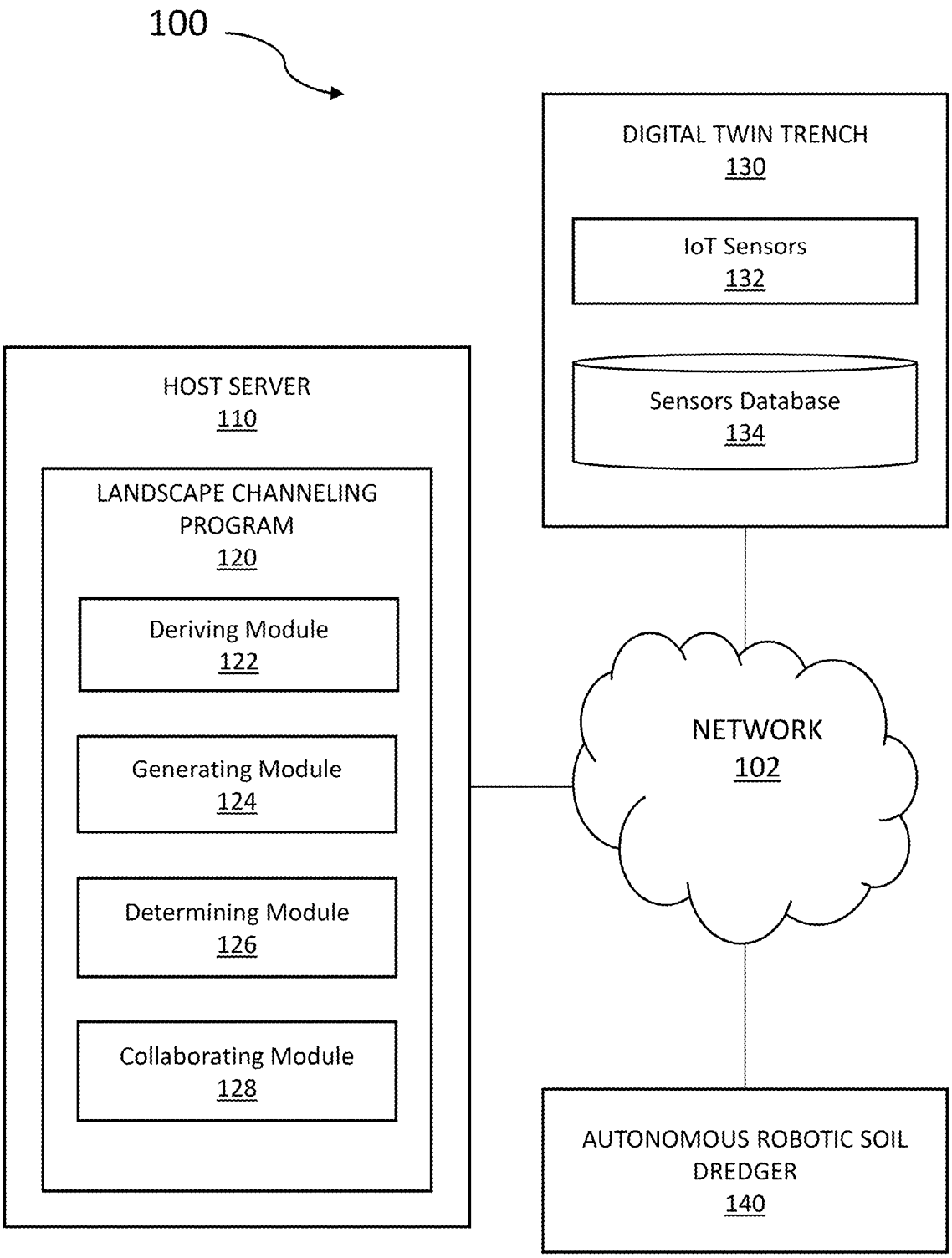
FIG. 1 illustrates a landscape channeling computing environment, in accordance with an embodiment of the present disclosure.

The present disclosure discloses a method for dynamic landscape channeling using an autonomous robotic soil dredger.

Channeling a trench, or trenching, can be thought of as a more extensive form of ploughing. Trenching improves water infiltration and reduces soil erosion by reducing water runoff.

Trenching comes with a variety of pre-existing problems that the current disclosure takes into consideration. For example, a landscape may need optimum leveling to allow an excess flow of water, since water flow uses gravity to transport the water runoff downhill. Leveling a landscape allows water to flow evenly throughout the fields.

Other pre-existing problems include a landscape with barren or wind erosion require frequent and continuous trenching post-wind to preserve the trench that is getting submerged with eroded soil. Furthermore, longer, steeper slopes or trenches can cause potential soil erosion.

Currently, when there is no information on the amount of water getting absorbed (e.g., soil moisture metrics), the water flowing/stored/recharged is manually controlled leading to surges of water and runoff. The soil is not getting optimal irrigation based on the type of soil, vegetation, etc.

Another pre-existing problem is unsealed channels or the breaking of channel barriers which leads to water runoff to unwanted trenches thereby causing a surge in one part of the irrigation and a deficit in the other part of the irrigation.

Nowadays, manual judgment of a soil absorption rate is estimated, together with manual operation of dams during water discharge into channels. For example, water is typically absorbed at a higher rate in sandy soils as opposed to clay soils. A tangential problem with varying soil absorption rates is surge flooding, which is an excessive amount of water discharged into the channels.

The present disclosure details a method and a system for cognitive, dynamic trenching (i.e., channeling) to achieve water retention, optimal soil water absorption, groundwater recharge based on the landscape profile (e.g., barren, contour, mountainous, etc.) and therefore based on the context of the water requirement, the autonomous robotic soil dredger is able to generate dynamic channels, channel metrics, and channel patterns based on the landscape profile, water availability and consumption, soil profiles, etc.

The present disclosure accomplishes its novel method and system using IoT and smart agriculture comprising three distinct layers: device, network, and application. The device layer consists of physical objects that are capable of automatic identification, sensing, or actuation, connected to the internet. The network layer communicates the data to the internet (i.e., cloud) using communication protocols. The application layer typically stores and facilitates access for the end-user to the processed/analyzed information.

The proposed system will be able to derive landscape metrics of the land-like dimensions, slope of the land, soil properties (e.g., soil type, soil absorption rate, etc.), and weather and climatic conditions.

Hereinafter, exemplary embodiments of the present disclosure will be described in detail with reference to the attached drawings.

The present disclosure is not limited to the exemplary embodiments below but may be implemented with various modifications within the scope of the present disclosure. In addition, the drawings used herein are for purposes of illustration, and may not show actual dimensions.

FIG. 1 illustrates landscape channeling computing environment 100, in accordance with an embodiment of the present disclosure. Landscape channeling computing environment 100 includes host server 110, digital twin trench 130, and autonomous robotic soil dredger 140 all connected via network 102. The setup in FIG. 1 represents an example embodiment configuration for the present disclosure and is not limited to the depicted setup to derive benefit from the present disclosure.

In an exemplary embodiment, host server 110 includes landscape channeling program 120. In various embodiments, host server 110 may be a laptop computer, tablet computer, netbook computer, personal computer (PC), a desktop computer, a personal digital assistant (PDA), a smart phone, a server, or any programmable electronic device capable of communicating with digital twin trench 130 and autonomous robotic soil dredger 140 via network 102. Host server 110 may include internal and external hardware components, as depicted, and described in further detail below with reference to FIG. 3. In other embodiments, host server 110 may be implemented in a cloud computing environment, as described in relation to FIGS. 4 and 5, herein. Host server 110 may also have wireless connectivity capabilities allowing the host server 110 to communicate with digital twin trench 130, autonomous robotic soil dredger 140, and other computers or servers over network 102.

With continued reference to FIG. 1, digital twin trench 130 includes Internet of Things (IoT) sensors 132 and sensors database 134.

In exemplary embodiments, IoT sensors 132 can include a device, hardware component, module, or subsystem capable of recording, capturing, and detecting events (e.g., environmental, weather, temperature changes, moisture, and so forth) or changes in a user environment, or proximity, and sending the detected data to other electronics (e.g., host server 110), components (e.g., sensors database 134), or programs (e.g., landscape channeling program 120) within a system such as landscape channeling computing environment 100. In various embodiments, the detected data collected by IoT sensors 132 are instrumental in creating a knowledge corpus of a particular landscape.

IoT sensors 132, in exemplary embodiments, are located within digital twin trench 130 and may be a global positioning system (GPS), software application, proximity sensor, camera, microphone, light sensor, infrared sensor, weight sensor, temperature sensor, tactile sensor, motion detector, optical character recognition (OCR) sensor, occupancy sensor, heat sensor, analog sensor (e.g., potentiometers, force-sensing resistors), radar, radio frequency sensor, quick response (QR) code, video camera, digital camera, Internet of Things (IoT) sensors, lasers, gyroscopes, accelerometers, actuators, structured light systems, weather-based smart irrigation controllers, evapotranspiration (ET) controllers, and any other device(s) used for measuring, detecting, and recording soil metrics, environmental conditions, vegetation growth, and water consumption.

In exemplary embodiments, ET controllers use local weather data to adjust irrigation schedules. Evapotranspiration is the combination of evaporation from the soil surface and transpiration by plant materials. The ET controllers gather local weather information and make run-time water adjustments so that the landscape receives the appropriate amount of water.

ET weather data uses four weather parameters: temperature, wind, solar radiation, and humidity. There are three basic forms of these weather-based ET controllers.

First, there are signal-based ET controllers. Signal-based ET controllers use meteorological data from a publicly available source and the ET value is calculated for a grass surface at the landscape site. The ET data is then sent to the controller by a wireless connection.

Second, there are historic ET controllers. Historic ET controllers use a pre-programmed water use curve, based on historic water use in different regions. The curve can be adjusted for temperature and solar radiation.

Third, there are on-site weather measurement controllers. On-site weather measurement controllers use weather data collected on-site to calculate continuous ET measurements and water accordingly.

In exemplary embodiments, IoT sensors 132 are capable of continuously monitoring, collecting, and saving collected data on a local storage, such as sensors database 134, or sending the collected data to landscape channeling program 120. In alternative embodiments, IoT sensors 132 may be capable of detecting, communicating, pairing, or syncing with internet of things (IoT) devices, thus creating opportunities for more direct integration of the physical world into computer-based systems, and resulting in improved efficiency, accuracy, and economic benefit in addition to reduced human intervention.

In exemplary embodiments, sensors database 134 may be local data storage on digital twin trench 130 that contains one or more sets of learning data. Learning data may include data sets comprising gathered data from IoT sensors 132, such as landscape metrics (e.g., land-like dimensions, slope of the land, etc.), soil metrics (e.g., soil type, soil absorption rate, etc.), trench and ridge metrics (e.g., depth of trench, distance between trenches, stream size, slope of the trench, shape of the trench, etc.), environmental conditions (e.g., historical rainfall and water availability, etc.), and vegetation water consumption (e.g., vegetation and plant types).

While sensors database 134 is depicted as being stored on digital twin trench 130, in other embodiments, sensors database 134 may be stored on host server 110, landscape channeling program 120, or any other device or database connected via network 102, as a separate database. In alternative embodiments, sensors database 136 may be comprised of a cluster or plurality of computing devices, working together, or working separately.

With continued reference to FIG. 1, autonomous robotic soil dredger 140 can include a device, hardware component, module, or subsystem capable of recording, capturing, and detecting events (e.g., environmental, weather, temperature changes, moisture, and so forth) or changes in a user environment, or proximity, and sending the detected data to other electronics (e.g., host server 110), components (e.g., sensors database 134), or programs (e.g., landscape channeling program 120) within a system such as landscape channeling computing environment 100. In various embodiments, autonomous robotic soil dredger 140 is the device component of the proposed system (i.e., landscape channeling program 120) that constructs required ridges and trenches based on derived landscape metrics, determined trench patterns, generated soil water retention and absorption patterns, and the determined amount of soil to be excavated.

In alternative embodiments, autonomous robotic soil dredger 140 may include the same, or similar components as digital twin trench 130, such as IoT sensors 132 and sensors database 134. In exemplary embodiments autonomous robotic soil dredger 140 may be capable of communicating with digital twin trench 130 and host server 110 via network 102, Wireless Fidelity (WiFi), and Radio Frequency Identification (RFID), or by any other means known to one of ordinary skill in the art.

In exemplary embodiments, autonomous robotic soil dredger 140 may be a remote-controlled, fully automated, and/or manned dredger that provides irrigation canal maintenance in accordance with exemplary embodiments herein.

With continued reference to FIG. 1, landscape channeling program 120, in an exemplary embodiment, may be a computer application on host server 110 that contains instruction sets, executable by a processor. The instruction sets may be described using a set of functional modules. In exemplary embodiments, landscape channeling program 120 may receive input from digital twin trench 130 and autonomous robotic soil dredger 140 over network 102. In alternative embodiments, landscape channeling program 120 may be a computer application contained within digital twin trench 130 or a standalone program on a separate electronic device.

With continued reference to FIG. 1, the functional modules of landscape channeling program 120 include deriving module 122, generating module 124, determining module 126, and collaborating module 128.

Figure 2:
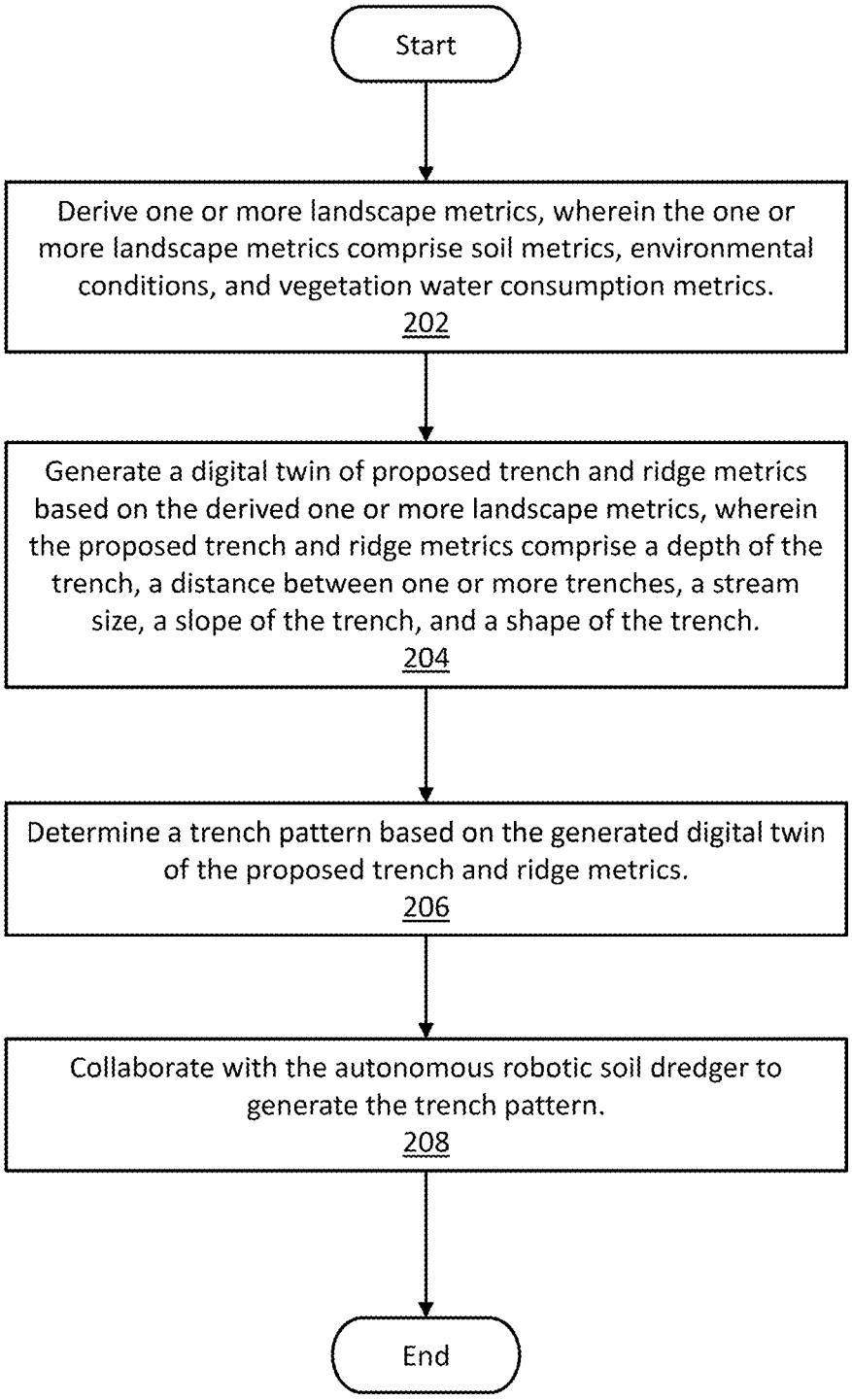
FIG. 2 is a flowchart illustrating the operation of landscape channeling program 120 of FIG. 1, in accordance with an embodiment of the present disclosure.

FIG. 2 is a flowchart illustrating the operation of landscape channeling program 120 of FIG. 1, in accordance with embodiments of the present disclosure.

With reference to FIGS. 1 and 2, deriving module 122 includes a set of programming instructions in landscape channeling program 120, to derive one or more landscape metrics, wherein the one or more landscape metrics comprise soil metrics, environmental conditions, and vegetation water consumption metrics (step 202). The set of programming instructions is executable by a processor.

In exemplary embodiments, soil metrics may include but is not limited to type of soil and soil absorption rate. The proposed system determines soil metrics via IoT sensors 132.

With reference to an illustrative example, Farmer Joe has been having difficulty growing his crop due to insufficient irrigation on his land in upstate NY. Farmer Joe's land gets a lot of east wind which continuously submerges the ground soil in his irrigation trenches. Using landscape channeling program 120, Farmer Joe's landscape metrics are derived via IoT sensors 132. Deriving module 122 provides data output depicting soil metrics <sandy; absorption 0.05 l/sec>, environmental conditions <30" rainfall per year>, and vegetation water consumption <potatoes; 2"/wk><tomatoes; 1"/wk><carrots; 1"/wk>.

With continued reference to FIGS. 1 and 2, generating module 124 includes a set of programming instructions in landscape channeling program 120, to generate a digital twin of proposed trench and ridge metrics based on the derived one or more landscape metrics, wherein the proposed trench and ridge metrics comprise a depth of the trench, a distance between one or more trenches, a stream size, a slope of the trench, and a shape of the trench (step 204). The set of programming instructions are executable by a processor.

A digital twin is a virtual model designed to accurately reflect a physical object. The object being studied (e.g., trenches) is outfitted with various sensors (e.g., IoT sensors 132) related to soil metrics, environmental conditions, and vegetation water consumption. This data is then relayed to a processing system and applied to the digital copy.

Once informed with such data, the virtual digital twin model can be used to run simulations, study performance issues, and generate possible improvements, all with the goal of generating valuable insights which can then be applied back to the original physical object.

By having better and constantly updated data related to a wide range of areas, combined with the added computing power that accompanies a virtual environment, digital twins can study more issues from far more vantage points than standard simulations can, with greater ultimate potential to improve products and processes.

In exemplary embodiments, the digital twin model identifies each sensor feed, via IoT sensors 132 of a landscape and creates its digital twin (i.e., digital twin trench 130).

In exemplary embodiments, the generated digital twin trench 130 of the proposed trench and ridge metrics can dynamically generate a soil water retention and absorption pattern based on relative positioning of one or more vegetation root systems, one or more adjacent trenches, soil metrics, and water retention schedule and runoff amount.

Based on the generated digital twin trench 130, the proposed system will be able to generate a crop profiling. The generated crop profiling includes a type of crop, a positioning of the crop, an amount of sunlight required, and amount of moisture or water required, nutrient requirements, and so forth.

In exemplary embodiments, generating module 124 can dynamically generate the wetting pattern of a crop based on relative positioning of the crop root system and one or more adjacent trench parameters, soil parameters, water flow schedules, and amount of water run-off.

Based on the soil, weather, and landscape profiles, generating module 124 can generate a crop recommendation and/or alternatively determine a suitability of a crop in the soil profile.

In exemplary embodiments, the generated digital twin trench 130 of the proposed trench and ridge metrics can dynamically generate a soil water retention and absorption pattern based on relative positioning of one or more vegetation root systems, one or more adjacent trenches soil metrics, and water retention schedule and runoff amount.

In various exemplary embodiments, the shape of the trench may be U-shaped, tumbler shaped, and so forth.

In alternative embodiments, generating module 124 can perform a digital twin simulation to identify optimum trench and ridge metrics, based on a growth pattern of plant roots, a consumption pattern of water, humidity, weather conditions, and types of plants to improve water infiltration and reduce soil erosion. In so doing, the digital twin trench 130 simulation system will consider the IoT sensors 132 feed, visual data, and will be simulating the optimum channeling.

In alternative embodiments, generating module 124 can generate a three-dimensional (3D) visualization of the farming landscape aspects (e.g., water flow rate, soil wetting, depth of soil wetting, depth of trench, crop root conditions, and so forth).

In exemplary embodiments, digital twin trench 130 can use IoT data and its digital twin to generate relative seed positioning with respect to the trench and ridges based on crop and seed profiling, water requirement and supply, weather conditions, and shadowing of seeds.

With continued reference to the illustrative example above, landscape channeling program 120 assists Farmer Joe by generating a digital twin of proposed trench and ridge metrics of Joe's farmland, based on the derived landscape metrics. The digital twin runs simulations of Farmer Joe's farmland, amount of water needed for optimal vegetation growth, and soil absorption. Based on the landscape metrics, generating module 124 proposes a square-shaped trench with a depth of 1', a 6" distance between the one or more trenches, and a 25-degree slope so that the water will reach the downstream end without excessive percolation losses.

With continued reference to FIGS. 1 and 2, determining module 126 includes a set of programming instructions in landscape channeling program 120, to determine a trench pattern based on the generated digital twin of the proposed trench and ridge metrics (step 206). The set of programming instructions is executable by a processor.

In various exemplary embodiments, the trench pattern may include but is not limited to: zig-zag, square, circular, contour, rectangular, T-shaped, and/or any other pattern that allows for optimal irrigation of the landscape.

In exemplary embodiments, the slope of the trench pattern may include but is not limited to: a uniform trench, a flat basin trench, a wide slope trench, a medium slope trench, a gentle slope trench, a narrow slope trench, and/or any other slope that allows for optimal irrigation of the landscape.

Uniform, flat basin, or gentle slope trenches are preferred for channels and should not exceed a 0.5% grade. Usually, gentle slope trenches provide up to a 0.5% grade to assist drainage following water flow or excessive rainfall with high intensity.

In exemplary embodiments, spacing between trenches are determined by the natural circumstances (i.e., slope, soil type, and available stream size). However, other factors may influence the design of a flood channel system (e.g., trench depth, farming practice, and the field length).

In alternative embodiments, although trenches can be longer when the land slope is steeper, the maximum recommended trench row slope is a 0.5% grade to avoid soil erosion.

Trenches may also be level and are thus very similar to long narrow basins. However, a minimum grade of 0.05% is recommended so that effective drainage can occur following water discharge or excessive rainfall. If the land slope is steeper than 0.5% then trenches can be set at an angle to the main slope or even along the contour to keep trench slopes within the recommended limits.

Water infiltration rates vary according to a type of soil. In sandy soil, water infiltrates rapidly and as such, trenches should be short so that water will reach the downstream end without excessive percolation losses. In clay soil, the water infiltration rate is much lower than in sandy soil and, as such, trenches can be much longer than in sandy soil.

In exemplary embodiments, water flow varies depending on stream size. Normally, stream sizes up to 0.5 liters/second (1/sec) provide an adequate water flow, provided the channels are not too long. When larger streams are available, water moves rapidly down the flood channels, and as such, trenches can be longer. The maximum stream size that will not cause soil erosion depends on the flood channel's slope. In exemplary embodiments, it is recommended not to use stream sizes larger than 3.0 l/sec.

In exemplary embodiments, a trench depth affects water infiltration. Applying larger trench depths usually means that channels can be longer since there is more time available for water to flow down the flood channels and infiltrate the soil.

In various exemplary embodiments, trench shape is based on a soil type. For example, in sandy soil, water moves faster vertically than sideways (e.g., laterally). Narrow, deep, V-shaped flood channels are desirable to reduce the soil area through which water percolates. However, sandy soil is less stable and tends to collapse, which may reduce water flow efficiency.

In contrast with sandy soil, there is more lateral movement of water in clay soil and the infiltration rate is much less than for sandy soil. Thus, a wide shallow flood channel is desirable to obtain a large, wetted area to encourage infiltration.

Referring back to the illustrative example above, landscape channeling program 120 determines that, given the landscape metrics and results of the simulations run on the digital twin 130, the optimal trench pattern for Farmer Joe's irrigation system on his farmland is a rectangular trench pattern.

With continued reference to FIGS. 1 and 2, collaborating module 128 collaborates with the autonomous robotic soil dredger 140 to generate the trench pattern (step 208).

In exemplary embodiments, the autonomous robotic soil dredger 140 can determine an amount of soil to be excavated to construct a trench, based on the proposed trench and ridge metrics.

In further exemplary embodiments, landscape channeling program 120 can create and dissolve one or more micro dams based on the proposed trench and ridge metrics, soil metrics, water supply, and amount of water flow required.

In exemplary embodiments, autonomous robotic soil dredger 140 can determine, dynamically, a need for blocking or releasing ongoing water flow through the trench and narrowing or widening of the trench for a duration of time based on the soil metrics, an amount of wetting required, stream size, water supply, and fertilizer drift off.

Autonomous robotic soil dredger 140 can detect one or more anomalies, wherein the one or more anomalies comprise water run-off, surge flooding, water clogging, soil erosion, and water overflowing from one trench to another trench.

In exemplary embodiments, autonomous robotic soil dredger 140 can conduct a ridge construction or blockage release to mitigate the detected one or more anomalies.

In alternative embodiments, the autonomous robotic soil dredger 140 can synchronize with water flow controllers an amount of water, stream speed, and duration of water runoff based on the environmental conditions, trench pattern, soil metrics, and wetting pattern.

In further exemplary embodiments, the autonomous robotic soil dredger 140 can control, dynamically, an initiation, a termination, and a pause of water flow into the trench.

In exemplary embodiments, landscape channeling program 120 can send an alert based on any changes to one or more characteristics of the trench and initiate, automatically, maintenance and re-trenching either before or after a water discharge to maintain the trench and ridge shape, size, pattern, and slope.

For example, in a barren or desert landscape with frequent wind direction, there is a considerable deposit of sand into the trenches making them un-usable. Further, the deposit of sand into the trenches can cause blockage (e.g., water clogging) leading to unwanted soil erosion. To avoid such situations, autonomous robotic soil dredger 140 can dynamically determine any changes in the landscape and re-trench where necessary.

Referring to the illustrative example above, landscape channeling program 120 connects with autonomous robot soil dredger 140 via network 102 to generate the determined trench pattern. Autonomous robot soil dredger 140 dredges the trench in the landscape according to specific parameters, based on the digital twin trench 130 (e.g., depth of the trench, distance between the trenches, stream size, slope of the trench, and shape of the trench). Farmer Joe now has an optimal irrigation system that dynamically generates the soil water retention and absorption pattern of the soil.

In exemplary embodiments, network 102 is a communication channel capable of transferring data between connected devices and may be a telecommunications network used to facilitate telephone calls between two or more parties comprising a landline network, a wireless network, a closed network, a satellite network, or any combination thereof. In another embodiment, network 102 may be the Internet, representing a worldwide collection of networks and gateways to support communications between devices connected to the Internet. In this other embodiment, network 102 may include, for example, wired, wireless, or fiber optic connections which may be implemented as an intranet network, a local area network (LAN), a wide area network (WAN), or any combination thereof. In further embodiments, network 102 may be a Bluetooth® network, a WiFi network, a vehicle-to-vehicle (V2V) network, a vehicle-to-infrastructure (V2I) network, a peer-to-peer (P2P) communication network, a mesh network, or a combination thereof. In general, network 102 can be any combination of connections and protocols that will support communications between host server 110, digital twin trench 130, and autonomous robotic soil dredger 140.

Figure 3:
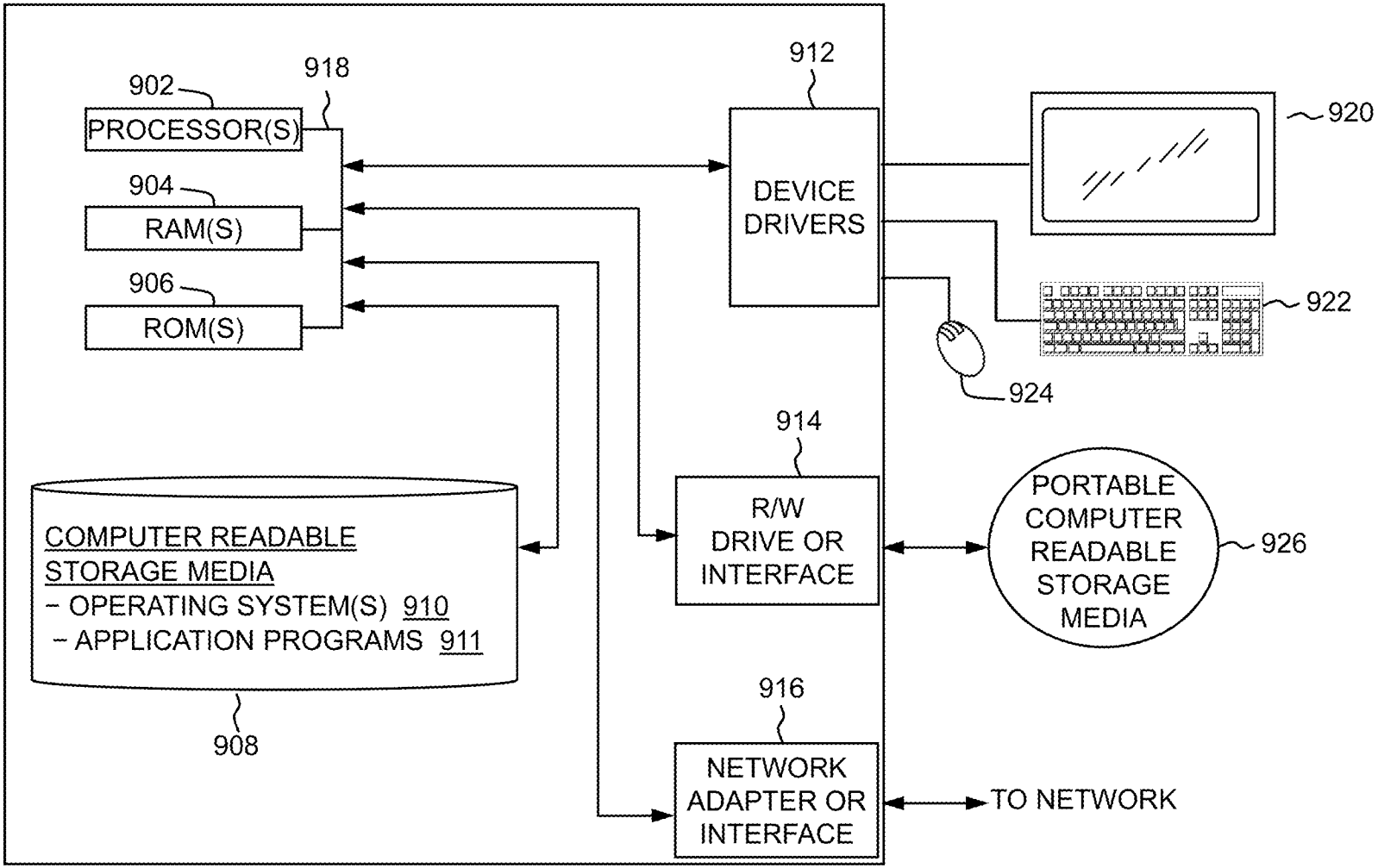
FIG. 3 is a diagram graphically illustrating the hardware components of landscape channeling computing environment of FIG. 1, in accordance with an embodiment of the present disclosure.

FIG. 3 is a block diagram depicting components of a computing device (such as host server 110, as shown in FIG. 1), in accordance with an embodiment of the present invention. It should be appreciated that FIG. 3 provides only an illustration of one implementation and does not imply any limitations with regard to the environments in which different embodiments may be implemented. Many modifications to the depicted environment may be made.

Computing device of FIG. 3 may include one or more processors 902, one or more computer-readable RAMs 904, one or more computer-readable ROMs 906, one or more computer readable storage media 908, device drivers 912, read/write drive or interface 914, network adapter or interface 916, all interconnected over a communications fabric 918. Communications fabric 918 may be implemented with any architecture designed for passing data and/or control information between processors (such as microprocessors, communications, and network processors, etc.), system memory, peripheral devices, and any other hardware components within a system.

One or more operating systems 910, and one or more application programs 911, such as landscape channeling program 120, may be stored on one or more of the computer readable storage media 908 for execution by one or more of the processors 902 via one or more of the respective RAMs 904 (which typically include cache memory). In the illustrated embodiment, each of the computer readable storage media 908 may be a magnetic disk storage device of an internal hard drive, CD-ROM, DVD, memory stick, magnetic tape, magnetic disk, optical disk, a semiconductor storage device such as RAM, ROM, EPROM, flash memory or any other computer-readable tangible storage device that can store a computer program and digital information.

Computing device of FIG. 3 may also include a R/W drive or interface 914 to read from and write to one or more portable computer readable storage media 926. Application programs 911 on computing device of FIG. 3 may be stored on one or more of the portable computer readable storage media 926, read via the respective RAY drive or interface 914 and loaded into the respective computer readable storage media 908.

Computing device of FIG. 3 may also include a network adapter or interface 916, such as a TCP/IP adapter card or wireless communication adapter (such as a 4G wireless communication adapter using OFDMA technology). Application programs 911 on computing device of FIG. 3 may be downloaded to the computing device from an external computer or external storage device via a network (for example, the Internet, a local area network or other wide area network or wireless network) and network adapter or interface 916. From the network adapter or interface 916, the programs may be loaded onto computer readable storage media 908. The network may comprise copper wires, optical fibers, wireless transmission, routers, firewalls, switches, gateway computers and/or edge servers.

Computing device of FIG. 3 may also include a display screen 920, a keyboard or keypad 922, and a computer mouse or touchpad 924. Device drivers 912 interface to display screen 920 for imaging, to keyboard or keypad 922, to computer mouse or touchpad 924, and/or to display screen 920 for pressure sensing of alphanumeric character entry and user selections. The device drivers 912, R/W drive or interface 914 and network adapter or interface 916 may comprise hardware and software (stored on computer readable storage media 908 and/or ROM 906).

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as Follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as Follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as Follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 4:
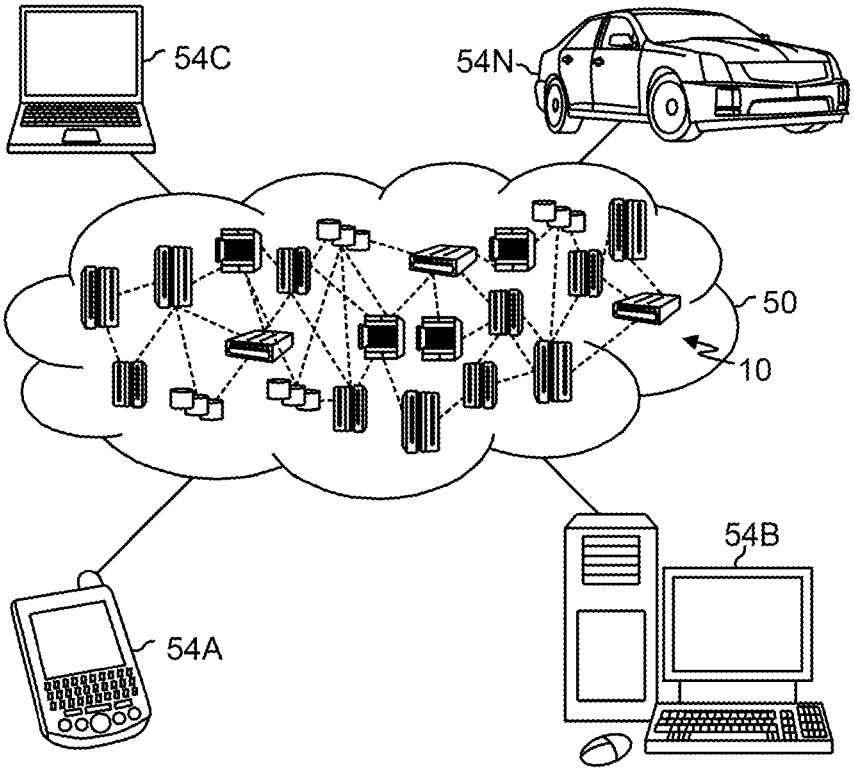
FIG. 4 depicts a cloud computing environment, in accordance with an embodiment of the present disclosure.

Referring now to FIG. 4, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 4 are intended to be illustrative only and that computing nodes 10 and cloud computing environment 50 can communicate with any type of computerized device over any type of network and/or network addressable connection (e.g., using a web browser).

Figure 5:
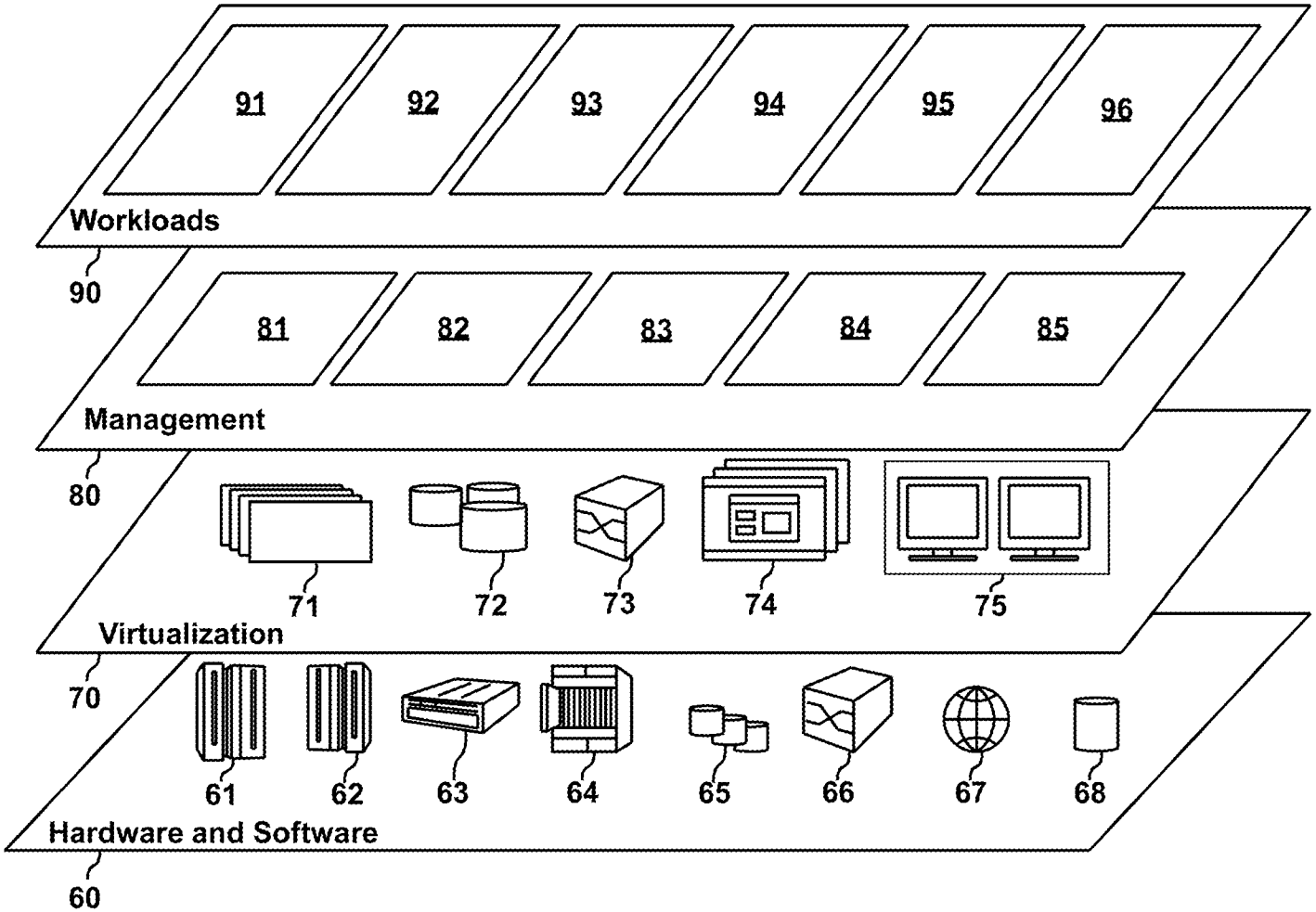
FIG. 5 depicts abstraction model layers of the illustrative cloud computing environment of FIG. 4, in accordance with an embodiment of the present disclosure.

Referring now to FIG. 5, a set of functional abstraction layers provided by cloud computing environment 50 (FIG. 4) is shown. It should be understood in advance that the components, layers, and functions shown in FIG. 5 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and controlling access to data objects 96.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus, or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Based on the foregoing, a computer system, method, and computer program product have been disclosed. However, numerous modifications and substitutions can be made without deviating from the scope of the present invention. Therefore, the present invention has been disclosed by way of example and not limitation.

What is claimed is:

1. A computer-implemented method for dynamic landscape channeling using an autonomous robotic soil dredger to reduce soil erosion by reducing runoff, comprising:

deriving one or more landscape metrics, wherein the one or more landscape metrics comprise soil metrics, environmental conditions, and vegetation water consumption metrics;

generating a digital twin of proposed trench and ridge metrics based on the derived one or more landscape metrics, wherein the proposed trench and ridge metrics comprise a depth of the trench, a distance between one or more trenches, a stream size, a slope of the trench, and a shape of the trench;

measuring soil moisture content and soil absorption rate for the proposed trench and ridge metrics using sensor-based smart controllers, wherein the one or more trenches are outfitted with the sensor-based smart controllers;

determining a trench pattern based on the generated digital twin of the proposed trench and ridge metrics; and collaborating with the autonomous robotic soil dredger to generate the trench pattern.

2. The computer-implemented method of claim 1, wherein the generated digital twin of the proposed trench and ridge metrics can dynamically generate a soil water retention and absorption pattern based on relative positioning of one or more vegetation root systems, one or more adjacent trenches, soil metrics, and water retention schedule and runoff amount.

3. The computer-implemented method of claim 2, further comprising:

determining an amount of soil to be excavated to construct a trench, based on the proposed trench and ridge metrics; and creating and dissolving one or more micro dams based on the proposed trench and ridge metrics, soil metrics, water supply, and amount of water flow required.

4. The computer-implemented method of claim 3, further comprising:

determining, dynamically, a need for blocking or releasing ongoing water flow through the trench and narrowing or widening of the trench for a duration of time based on the soil metrics, an amount of wetting required, the stream size, water supply, and fertilizer drift off.

5. The computer-implemented method of claim 3, further comprising:

detecting one or more anomalies, by the autonomous robotic soil dredger, wherein the one or more anomalies comprise water run-off, surge flooding, water clogging, soil erosion, water overflowing from one trench to another trench; and conducting, by the autonomous robotic soil dredger, a ridge construction or blockage release to mitigate the detected one or more anomalies.

6. The computer-implemented method of claim 3, further comprising:

synchronizing, by the autonomous robotic soil dredger, with water flow controllers an amount of water, stream speed, and duration of water runoff based on the environmental conditions, trench pattern, soil metrics, and wetting pattern; and controlling, dynamically, an initiation, a termination, and a pause of water flow into the trench.

7. The computer-implemented method of claim 3, further comprising:

sending an alert based on any changes to one or more characteristics of the trench; and initiating, automatically, maintenance and re-trenching either before or after a water discharge to maintain the trench and ridge shape, size, pattern, and slope.

8. The computer-implemented method of claim 1, further comprising:

performing a digital twin simulation to identify optimum trench and ridge metrics, based on a growth pattern of plant roots, a consumption pattern of water, humidity, weather conditions, and types of plants.

9. A computer program product, comprising a non-transitory tangible storage device having program code embodied therewith, the program code executable by a processor of a computer to perform a method, the method comprising: deriving one or more landscape metrics, wherein the one or more landscape metrics comprise soil metrics, environmental conditions, and vegetation water consumption metrics; generating a digital twin of proposed trench and ridge metrics based on the derived one or more landscape metrics, wherein the proposed trench and ridge metrics comprise a depth of the trench, a distance between one or more trenches, a stream size, a slope of the trench, and a shape of the trench; measuring soil moisture content and soil absorption rate for the proposed trench and ridge metrics using sensor-based smart controllers, wherein the one or more trenches are outfitted with the sensor-based smart controllers; determining a trench pattern based on the generated digital twin of the proposed trench and ridge metrics; and collaborating with the autonomous robotic soil dredger to generate the trench pattern.

10. The computer program product of claim 9, wherein the generated digital twin of the proposed trench and ridge metrics can dynamically generate a soil water retention and absorption pattern based on relative positioning of one or more vegetation root systems, one or more adjacent trenches, soil metrics, and water retention schedule and runoff amount.

11. The computer program product of claim 10, further comprising:

determining an amount of soil to be excavated to construct a trench, based on the proposed trench and ridge metrics; and creating and dissolving one or more micro dams based on the proposed trench and ridge metrics, soil metrics, water supply, and amount of water flow required.

12. The computer program product of claim 11, further comprising:

determining, dynamically, a need for blocking or releasing ongoing water flow through the trench and narrowing or widening of the trench for a duration of time based on the soil metrics, an amount of wetting required, the stream size, water supply, and fertilizer drift off.

13. The computer program product of claim 11, further comprising:

detecting one or more anomalies, by the autonomous robotic soil dredger, wherein the one or more anomalies comprise water run-off, surge flooding, water clogging, soil erosion, water overflowing from one trench to another trench; and conducting, by the autonomous robotic soil dredger, a ridge construction or blockage release to mitigate the detected one or more anomalies.

14. The computer program product of claim 11, further comprising:

synchronizing, by the autonomous robotic soil dredger, with water flow controllers an amount of water, stream speed, and duration of water runoff based on the environmental conditions, trench pattern, soil metrics, and wetting pattern; and controlling, dynamically, an initiation, a termination, and a pause of water flow into the trench.

15. A computer system, comprising: one or more computer devices each having one or more processors and one or more tangible storage devices; and a program embodied on at least one of the one or more storage devices, the program having a plurality of program instructions for execution by the one or more processors, the program instructions comprising instructions for: deriving one or more landscape metrics, wherein the one or more landscape metrics comprise soil metrics, environmental conditions, and vegetation water consumption metrics; generating a digital twin of proposed trench and ridge metrics based on the derived one or more landscape metrics, wherein the proposed trench and ridge metrics comprise a depth of the trench, a distance between one or more trenches, a stream size, a slope of the trench, and a shape of the trench; measuring soil moisture content and soil absorption rate for the proposed trench and ridge metrics using sensor-based smart controllers, wherein the one or more trenches are outfitted with the sensor-based smart controllers; determining a trench pattern based on the generated digital twin of the proposed trench and ridge metrics; and collaborating with the autonomous robotic soil dredger to generate the trench pattern.

16. The computer system of claim 15, wherein the generated digital twin of the proposed trench and ridge metrics can dynamically generate a soil water retention and absorption pattern based on relative positioning of one or more vegetation root systems, one or more adjacent trenches, soil metrics, and water retention schedule and runoff amount.

17. The computer system of claim 16, further comprising:

determining an amount of soil to be excavated to construct a trench, based on the proposed trench and ridge metrics; and creating and dissolving one or more micro dams based on the proposed trench and ridge metrics, soil metrics, water supply, and amount of water flow required.

18. The computer system of claim 17, further comprising:

determining, dynamically, a need for blocking or releasing ongoing water flow through the trench and narrowing or widening of the trench for a duration of time based on the soil metrics, an amount of wetting required, the stream size, water supply, and fertilizer drift off.

19. The computer system of claim 17, further comprising:

detecting one or more anomalies, by the autonomous robotic soil dredger, wherein the one or more anomalies comprise water run-off, surge flooding, water clogging, soil erosion, water overflowing from one trench to another trench; and conducting, by the autonomous robotic soil dredger, a ridge construction or blockage release to mitigate the detected one or more anomalies.

20. The computer system of claim 17, further comprising:

synchronizing, by the autonomous robotic soil dredger, with water flow controllers an amount of water, stream speed, and duration of water runoff based on the environmental conditions, trench pattern, soil metrics, and wetting pattern; and controlling, dynamically, an initiation, a termination, and a pause of water flow into the trench.

* * * * *